US008537012B2

(12) United States Patent
Rapp et al.

(10) Patent No.: US 8,537,012 B2
(45) Date of Patent: Sep. 17, 2013

(54) DISPLAY ASSEMBLY WITH CABLE STOP

(75) Inventors: Michael Rapp, Modautal (DE); Dennis D. Belden, Jr., Canton, OH (US)

(73) Assignee: Checkpoint Systems, Inc.

( * ) Notice: Subject to any disclaimer, the term of this patent is extended or adjusted under 35 U.S.C. 154(b) by 249 days.

(21) Appl. No.: 12/878,090

(22) Filed: Sep. 9, 2010

(65) Prior Publication Data

US 2011/0068919 A1 Mar. 24, 2011

Related U.S. Application Data

(60) Provisional application No. 61/245,038, filed on Sep. 23, 2009.

(51) Int. Cl.
*G08B 13/12* (2006.01)

(52) U.S. Cl.
USPC ..... 340/568.2; 340/686.1; 340/572.1

(58) Field of Classification Search
USPC ..... 340/568.2, 568.1, 568.8, 500, 568.3, 340/571, 572.1, 686.1
See application file for complete search history.

(56) References Cited

U.S. PATENT DOCUMENTS

| | | | | |
|---|---|---|---|---|
| 5,136,635 | A | 8/1992 | Staggs | |
| 5,664,690 | A * | 9/1997 | Friesen | 211/88.01 |
| 6,039,496 | A | 3/2000 | Bishop | |
| 6,040,764 | A * | 3/2000 | Crisci | 340/432 |
| 6,201,569 | B1 * | 3/2001 | Kawashima et al. | 348/190 |
| 6,476,717 | B1 | 11/2002 | Gross et al. | |
| 7,046,214 | B2 * | 5/2006 | Ebersole et al. | 345/7 |
| 2005/0040949 | A1 | 2/2005 | Frederiksen et al. | |
| 2005/0073413 | A1 | 4/2005 | Sedon et al. | |
| 2005/0252156 | A1 * | 11/2005 | Martel et al. | 52/714 |
| 2007/0080805 | A1 * | 4/2007 | Franklin et al. | 340/572.1 |
| 2008/0156922 | A1 * | 7/2008 | Rabinowitz et al. | 242/372 |

* cited by examiner

*Primary Examiner* — Daniel Previl

(57) ABSTRACT

Methods and other embodiments associated with a display stand with a tether stop are presented. In the preferred embodiment, a display stand includes a base, a mounting member, a tether, a recoiler, and a cable stop. The mounting member is adapted for mounting thereon a display item and is movable between a mounted position in contact with the base. The mounting member is configured to be removed from the base to facilitate viewing and handling of the display item. The tether includes a connector located at one end of the tether to attach the tether to the mounting member. The recoiler recoils the tether. The cable stop moves to a first position to allow the connector to pass through an opening in the base and to a second position to prevent the connector from passing through the opening.

18 Claims, 9 Drawing Sheets

DISPLAY ASSEMBLY WITH CABLE STOP

CROSS REFERENCE TO RELATED APPLICATIONS

This application claims priority from U.S. Provisional Application Ser. No. 61/245,038 filed Sep. 23, 2009; the disclosure of which is incorporated herein by reference.

BACKGROUND OF THE INVENTION

1. Technical Field

This invention relates generally to display stands for merchandise. More particularly, the invention relates to a display stand which allows the handling of an item of merchandise. Specifically, the invention relates to a display stand that tethers an item of merchandise to the display stand with a tether that will sound an alarm if the tether is cut.

2. Background Information

Retail stores have a difficult time protecting boxes containing various merchandise and other similarly structured packages, or protecting such containers from being opened and the contents thereof being removed without authorization from store personnel or from being damaged while on display. Consumers often want to visually inspect the packaged expensive articles before deciding to purchase them. The store is faced with the problem of how to protect these expensive articles from theft while displaying them for sale.

One method used to protect these packages and the articles contained therein is to enclose the article within a transparent glass display case which can only be accessed by an authorized clerk. The consumer can view the article through the glass but is not able to handle the article or read any of the information about the article that may be printed on the box, unless a store clerk removes the article from the case. However, in large retail stores, the problem then arises of getting the selected merchandise to the customer after the customer wishes to purchase the same without subjecting the merchandise to theft. One manner is to maintain a supply of the boxes containing the expensive articles or merchandise close at hand for delivery to or pick-up by the customer for subsequent taking to a check-out clerk. However, this makes the boxes susceptible to theft and requires additional sales personnel.

Another method used by retail stores is to list the article in a catalog and require consumers to place an order from the catalog. The article is delivered from a back storage area and the consumer must simultaneously pick up and pay for the merchandise at the same location to prevent unauthorized removal from the store. The consumer has no chance to inspect the merchandise before purchasing, and if they are not satisfied they must undergo the inconvenience of returning the merchandise for a refund.

Some locking devices have adequately solved this problem of securing packages or objects in a closed condition while being displayed in retail stores or shipped from one location to another. Some of these devices include a wire which wraps around an article and is secured by some type of locking mechanism. Cable wrap security devices may require a special tool to operate the latch mechanism, both for tightening the cable about the object to be protected and to retract the security cable into the device after the security device has been removed from the package. Also, some require a mechanism to enable the internal spool on which the cable is wound to be free-wheeling in order for the cable to be pulled outwardly to a larger size for placement around another package.

Also, these devices usually require that the cable be manually rewound onto the spool for storage once the security device has been removed from the package. This requires additional work by the retail personnel, and if the cables are not properly rewound these cables will become tangled with other cables creating a storage problem and requiring additional work for reuse and replacement on a different package. A better way of protecting merchandise may be desired.

BRIEF DESCRIPTION OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
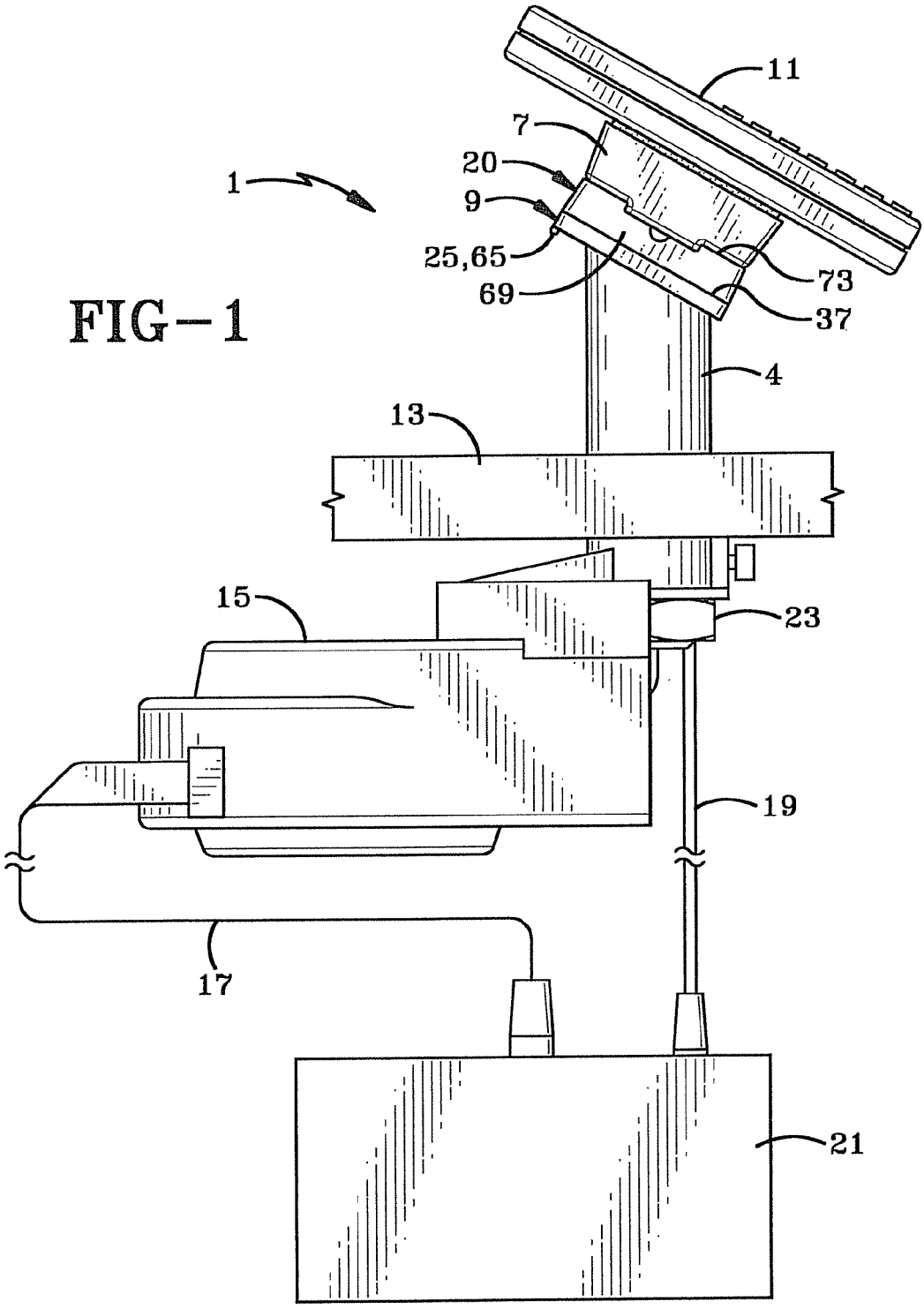
FIG. 1 illustrates a side view of a display assembly with a cable stop.
Figure 2:
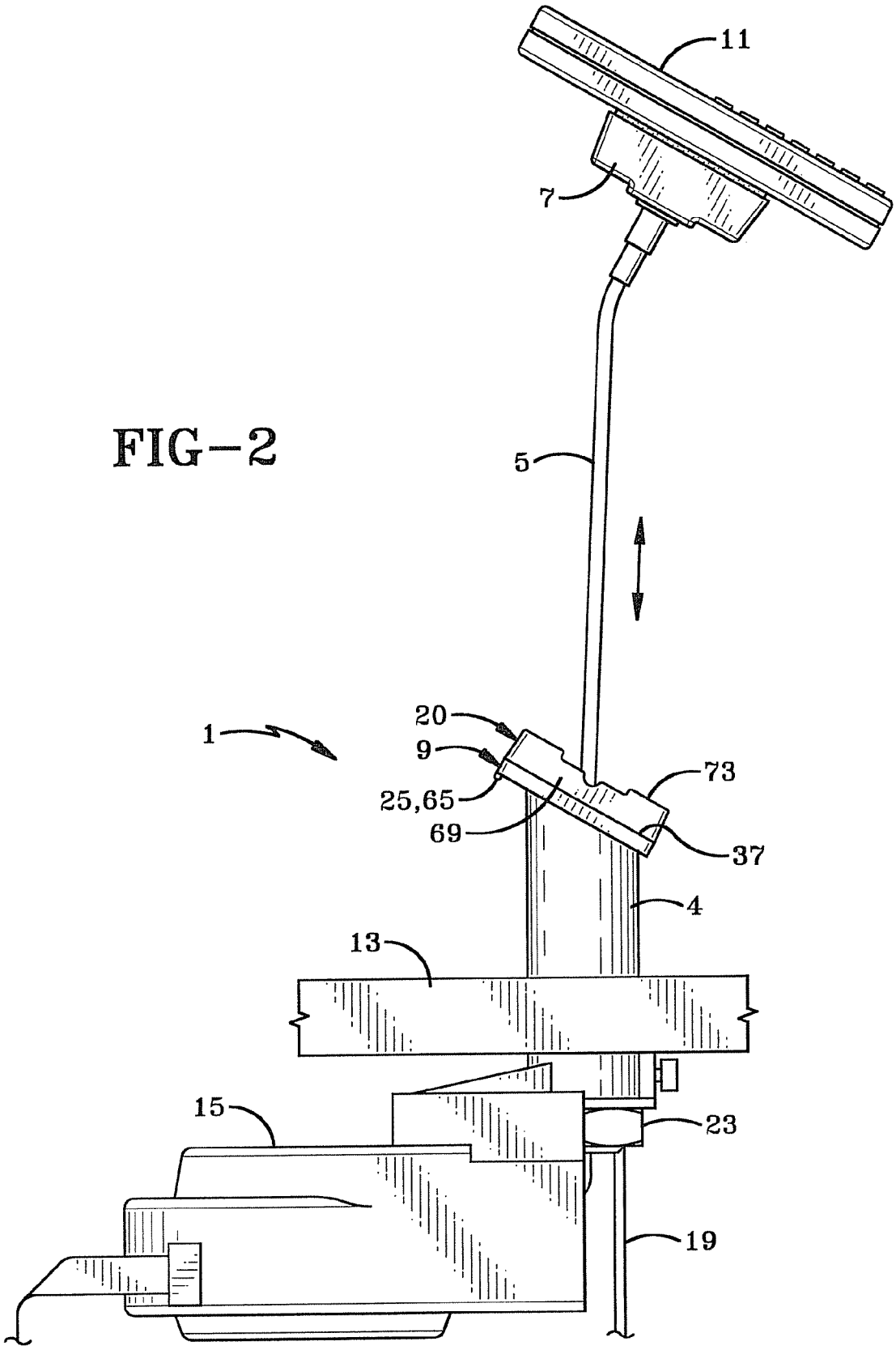
FIG. 2 illustrates another side view of a display assembly with cable stop.

Described herein are example methods and other embodiments associated with securely displaying consumer merchandise. Referring to FIG. 1, in the preferred embodiment, a display assembly 1 includes a base cover 4, a tether 5, a mounting member 7, a base plate 9, and a mounting adapter 20. A display item 11 may be securely attached to the mounting member 7. The display item 11 may be a consumer electronic device such as a digital camera or other electronic device. As shown in FIG. 2, a tether 5 is connected between the mounting member 7 allowing the mounting member 7 and display item 11 combination to be removed from the mounting adapter 20. The other end of the tether 5 may be securely attached to a recoiler 15. The recoiler 15 is in turn securely attached to a physical object such as a display case so that the tether 5 is not easily removed. The tether 5 allows a consumer to remove the display item 11 and mounting member 7 combination in order to view and touch the display item 11. For example, the consumer may press buttons and explore different features of a calculator mounted to the mounting member 7 while moving the calculator in an area permitted by the tether 5.

The tether 5 may provide both physical and electronic security. For example, in the preferred embodiment, physical security is provided by physically attaching one end of the tether 5 to the mounting member 7 and the other end of the tether 5 to a display case. Electrical wires in the other end of the tether 5 can be electrically connected through wire 17 to an alarm system 21 external to the display assembly 1.

A sensor in the mounting member 7 may be configured to detect whether the display item 11 has been removed from the mounting member 7. When this is detected, the sensor in combination with the tether 5 and wire 17 are configured to transmit a signal indicating this detection to the alarm system 21. Additionally, when the tether 5 is cut, a signal may be transmitted (e.g., a loss of voltage in the tether 5) to the alarm indicating that the tether 5 has been cut. When the alarm system 21 detects the arrival of one of these signals, the alarm system 21 may be configured to sound alarms and/or to take other appropriate actions as understood by those of ordinary skill in the art.

The base 3 may be formed with a round threaded portion 31. A nut 23 may be threaded onto the threaded portion 31 to secure the base cover 4 to the base 3 as well as securing the base 3 to a display surface 13. The base 3 may also be formed with a groove 33 and a cable opening 35. A wire 19 may be connected to a sensor (not shown) that may be included in the mounting adaptor 20. The wire 19 may be routed in the groove 33 in the base and through a cable opening 35.

Figure 3:
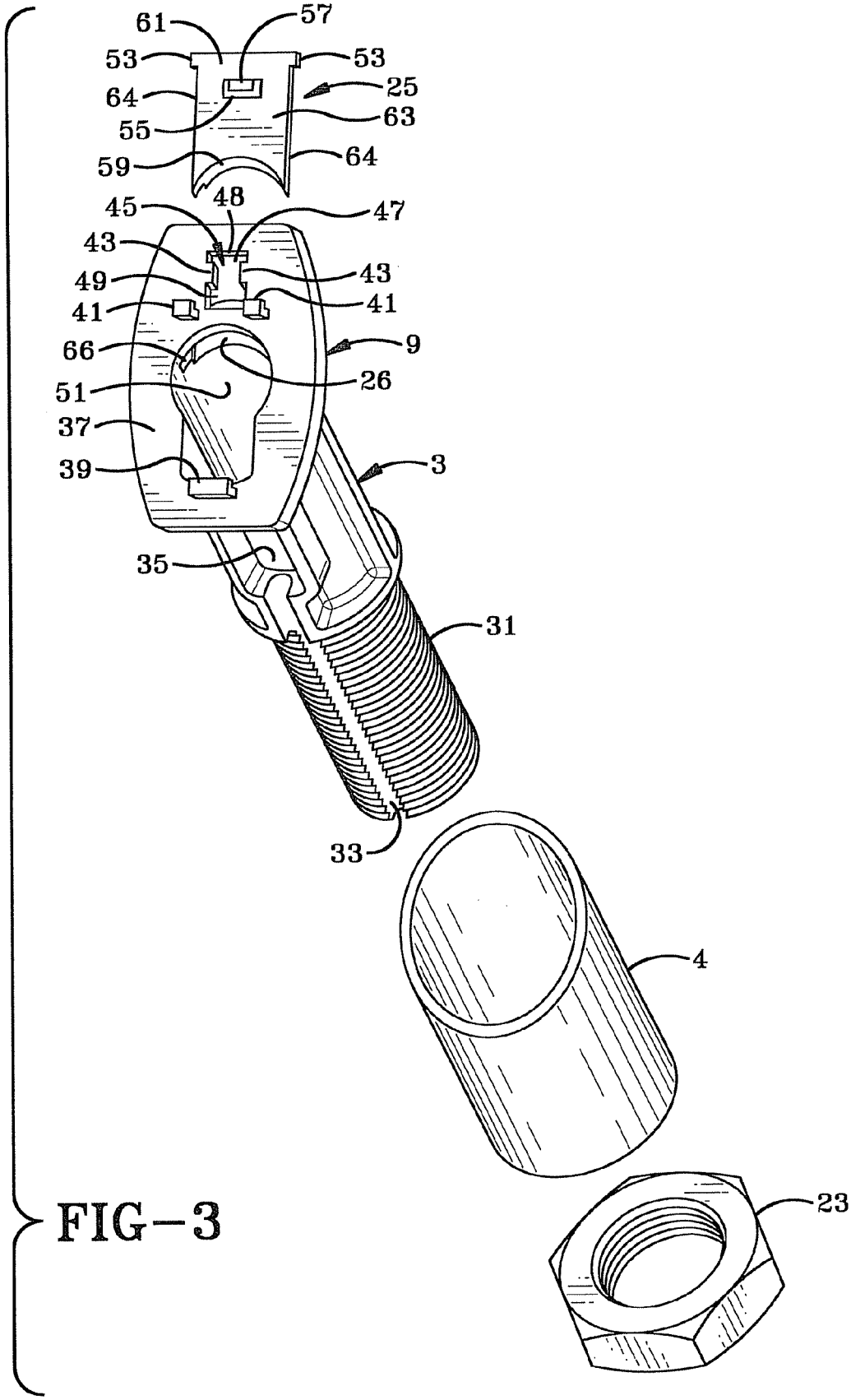
FIG. 3 illustrates an exploded view of a display assembly with a cable stop.
Figure 11:
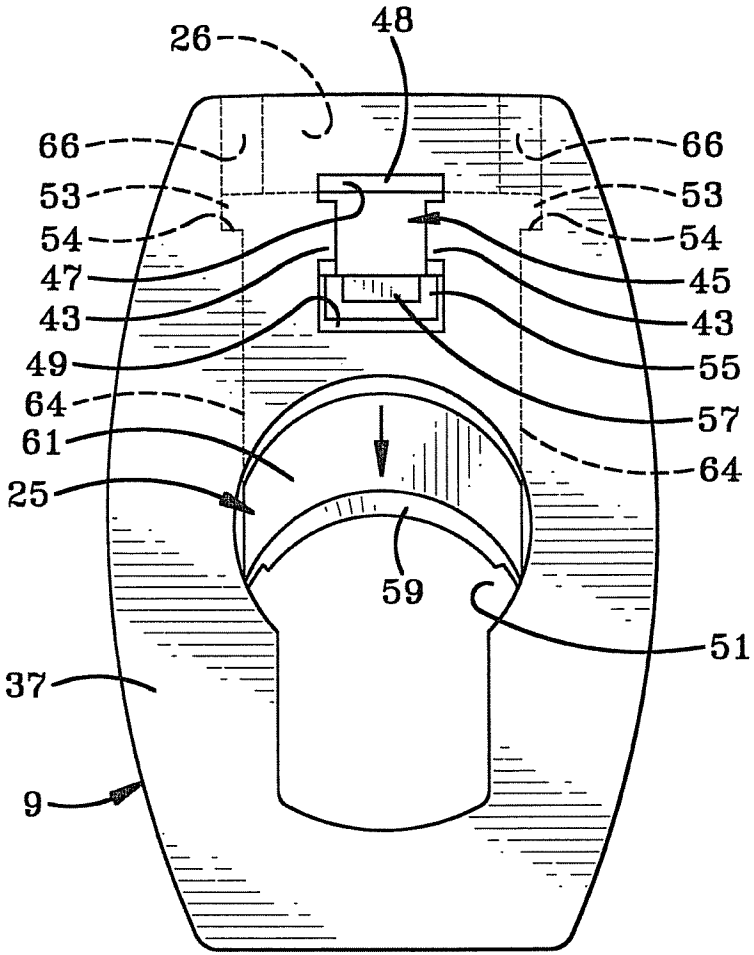
FIG. 11 illustrates a top view of a cable stop in a closed position.
Figure 8:
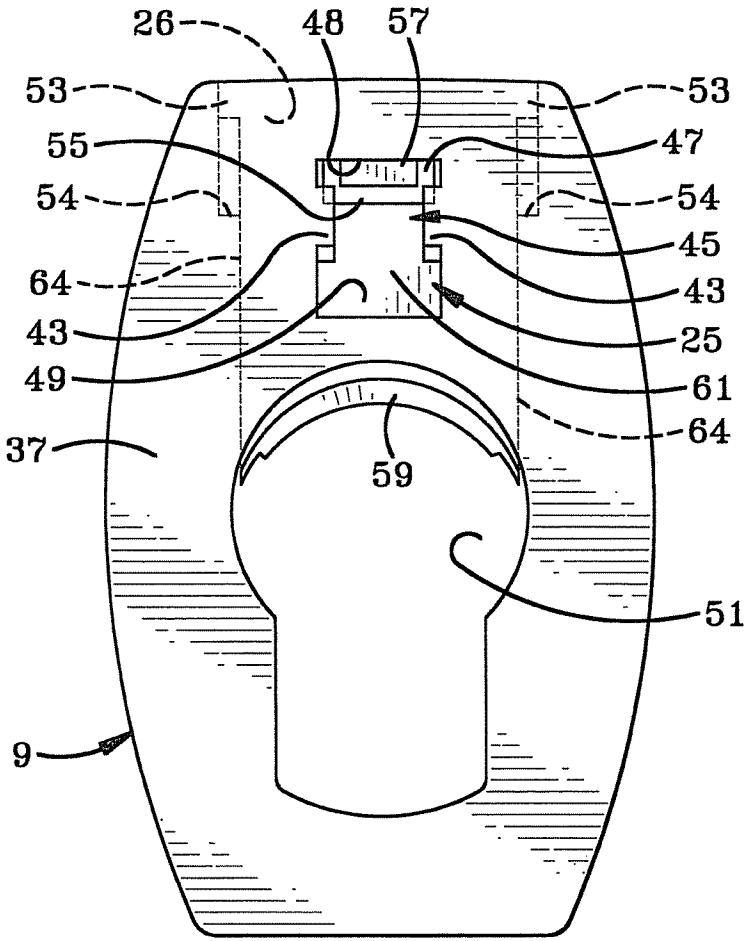
FIG. 8 illustrates a top view of a cable stop in an open position.

The recoiler 15 through springs or other biasing mechanisms provides a constant bias to the tether 5 that attempts to recoil the tether back into the recoiler 15. When the tether 5 is disconnected from the mounting member 7, the tether 5 can be recoiled back into the base 3, through an opening 51 (shown in FIG. 3) in the base plate 9, and pulled beneath the surface 13 of a display case that the display assembly 1 is mounted to. It can be time consuming to find and re-thread the tether 5 back through the base 3 and reconnect the tether 5 to another mounting member 7 when the tether 7 has been recoiled all the way back through the base 3 and below the surface 13. To prevent the tether 5 from recoiling below the surface 13 when the tether 5 is removed from the mounting member 7, the base plate 9 includes a cable stop 25 as shown in FIG. 3. The cable stop 25 is moved to an open position as shown in FIG. 8 when the tether 5 will not be disconnected from the mounting member 7. The open position allows the tether 5 to recoil into the base 3 and the recoiler 15. However, when the tether 5 needs to be disconnected from the mounting member 7, the cable stop 25 is moved to a partially closed (e.g., blocking) position as shown in FIG. 11. In this position, the cable stop 25 prevents the tether 5 from being pulled past the cable stop 25.

Figure 4:
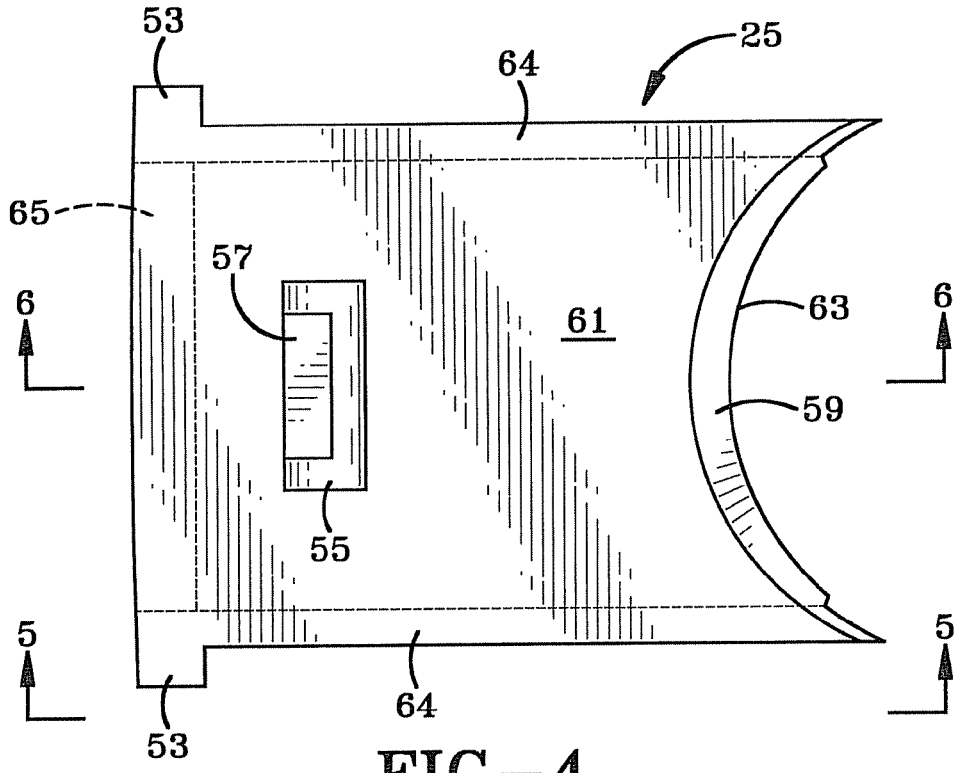
FIG. 4 illustrates a top view of a cable stop.
Figure 5:
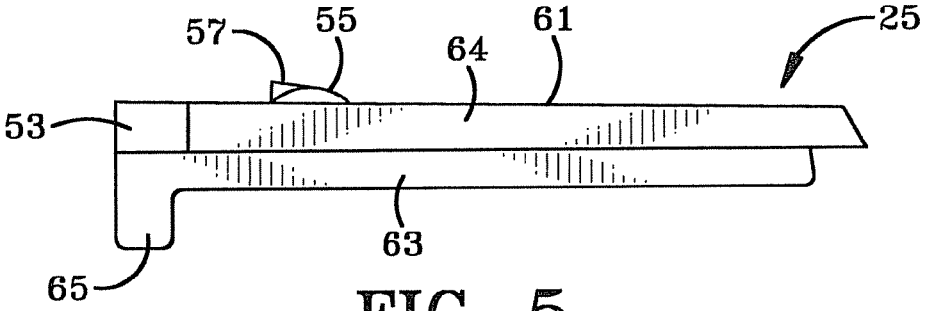
FIG. 5 illustrates a side view of a cable stop.
Figure 6:
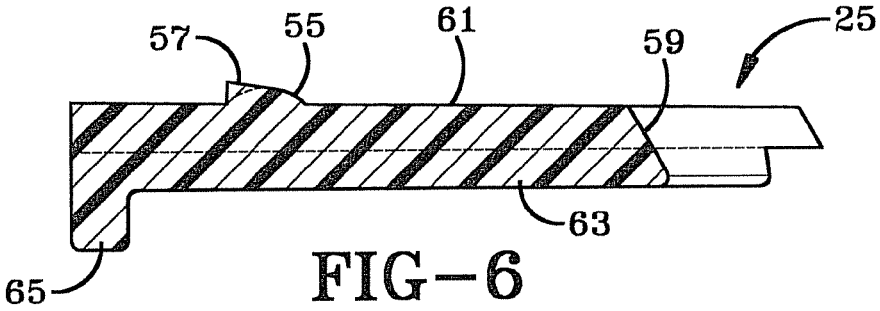
FIG. 6 illustrates a cross-sectional view of a cable stop.
Figure 10:
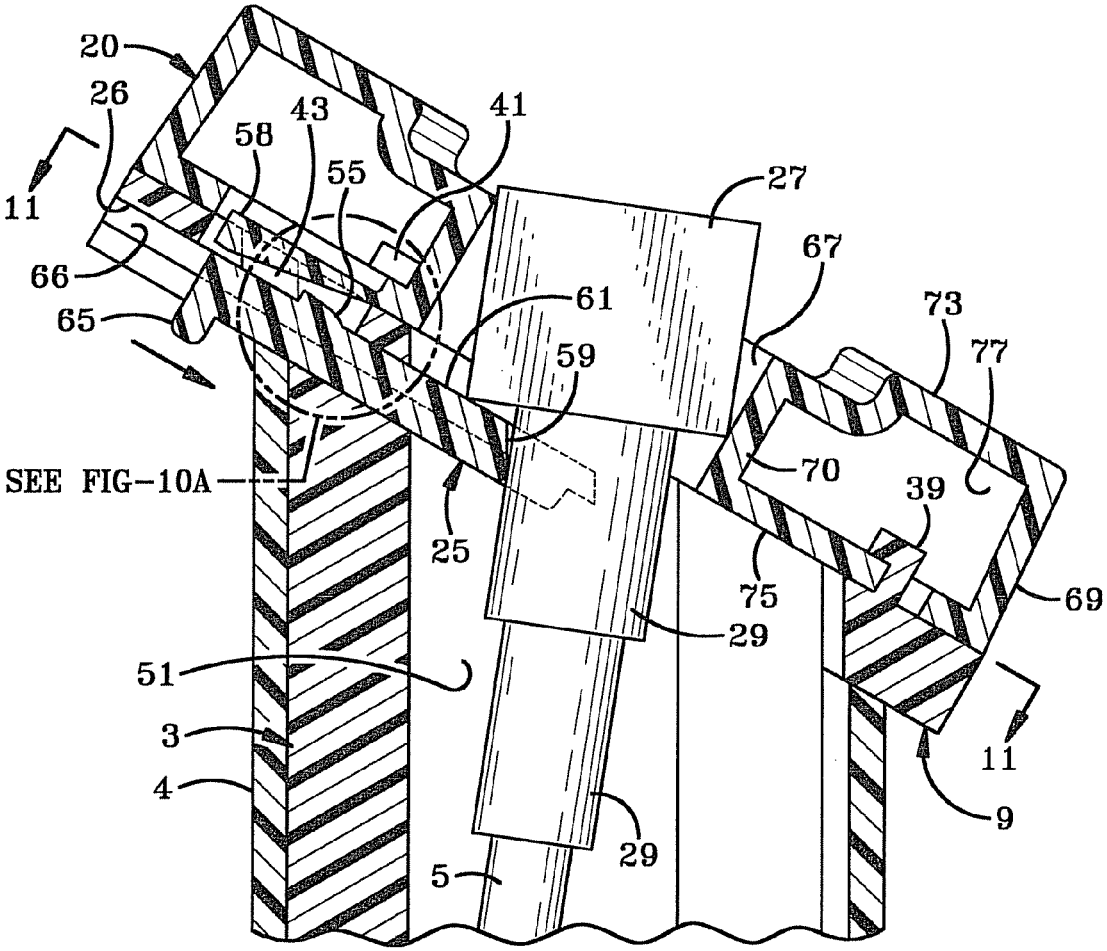
FIG. 10 illustrates a cross-sectional view of a display assembly with a cable stop in closed position.

In the preferred embodiment, the cable stop 25 is configured to slide within the base plate 9. The cable stop 25 can be slid into the base plate 9 through an opening 26 in the base plate 9 as best shown in FIGS. 3 and 10. The cable stop 25 may be formed with an angular protrusion 57 as shown in FIGS. 4-6. The angular protrusion 57 will extend through an opening 45 in the base plate 9 when the cable stop 25 is slid far enough into the base plate 9. The angular protrusion 57 may be configured to allow the cable stop 25 to be slid into the base plate 9 but not easily removed from the base plate 9. This is because a substantially flat vertical portion of the angular protrusion 57 is blocked by a stop wall 48 as shown best in FIG. 7A to prevent the cable stop 25 from being pulled out of the base plate 9.

Figure 9:
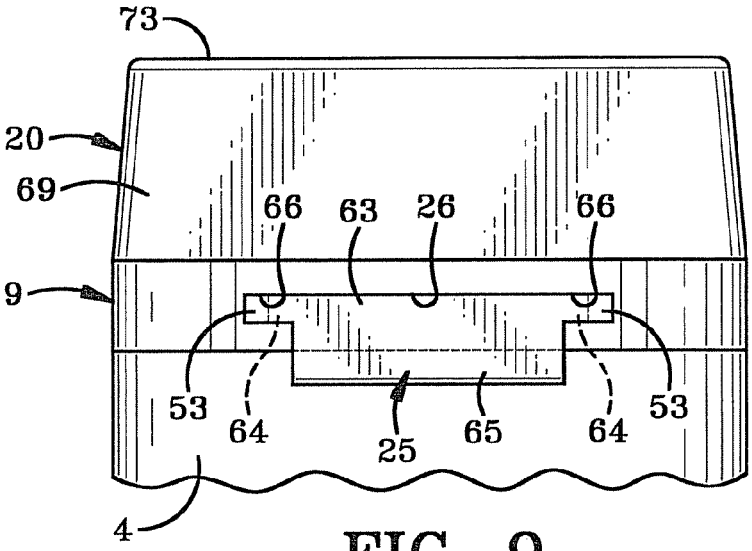
FIG. 9 illustrates a partial side view of a display assembly with a cable stop.

In the preferred embodiment, the cable stop 25 is generally planer in shape as shown in FIGS. 4-6. The cable stop 25 can be formed with a body portion 63. The cable stop 25 can be formed with two adjacent planer lips 64 that are parallel to each other on opposite sides of the planer surface 61. The lips 64 may appear as ledges of the body portion 63. The adjacent planer lips 64 may slide in two opposite grooves 66 (see FIGS. 9 and 10) or channels formed in the base plate 9. The cable stop 25 also is formed with two stop tabs 53. As best shown in FIGS. 4 and 11, the stop tabs 53 are blocked by stop ledges 54 to prevent the cable stop 25 from completely entering the opening 51.

In addition to the angular protrusion 57 that ensures the cable stop 25 generally cannot be withdrawn from the base plate 9, the cable stop 25 may include an additional protrusion 55. This protrusion 55 can regulate how the cable stop is moved between an open (e.g., non-blocking) position and a closed position (e.g., blocking) position. For example, the cable stop 25 can be positioned in the base plate 9 so that the protrusion 55 on the cable stop extends within a first open portion 47 of the opening 45 of the base plate 9 as shown in FIG. 8. When the protrusion is in the first open portion 47, the cable stop 25 is in the open position to allow the tether 5 to pass through the base plate 9. The cable stop 25 can be slid so the protrusion 55 extends through a second open portion 49 of the opening 45 of the base plate 9 as shown in FIG. 11. In this position, the cable stop 25 is in the partially closed position to block the tether 5 from passing through the base plate 9. A pair of adjacent blocking protrusions 43 (e.g., tabs) of the base plate 9 extend into the opening 45. The protrusion 55 of the cable stop 25 is pushed under the adjacent blocking protrusions 43 of the base plate 9 when moving the protrusion 55 between the first open portion 47 and the second open portion 49. The blocking protrusions 43 on the base plate 9 act to keep the cable stop 25 in one of the positions until a sufficient force is applied to push the protrusion 55 on the cable stop 25 under the blocking protrusions 43.

Figure 7:
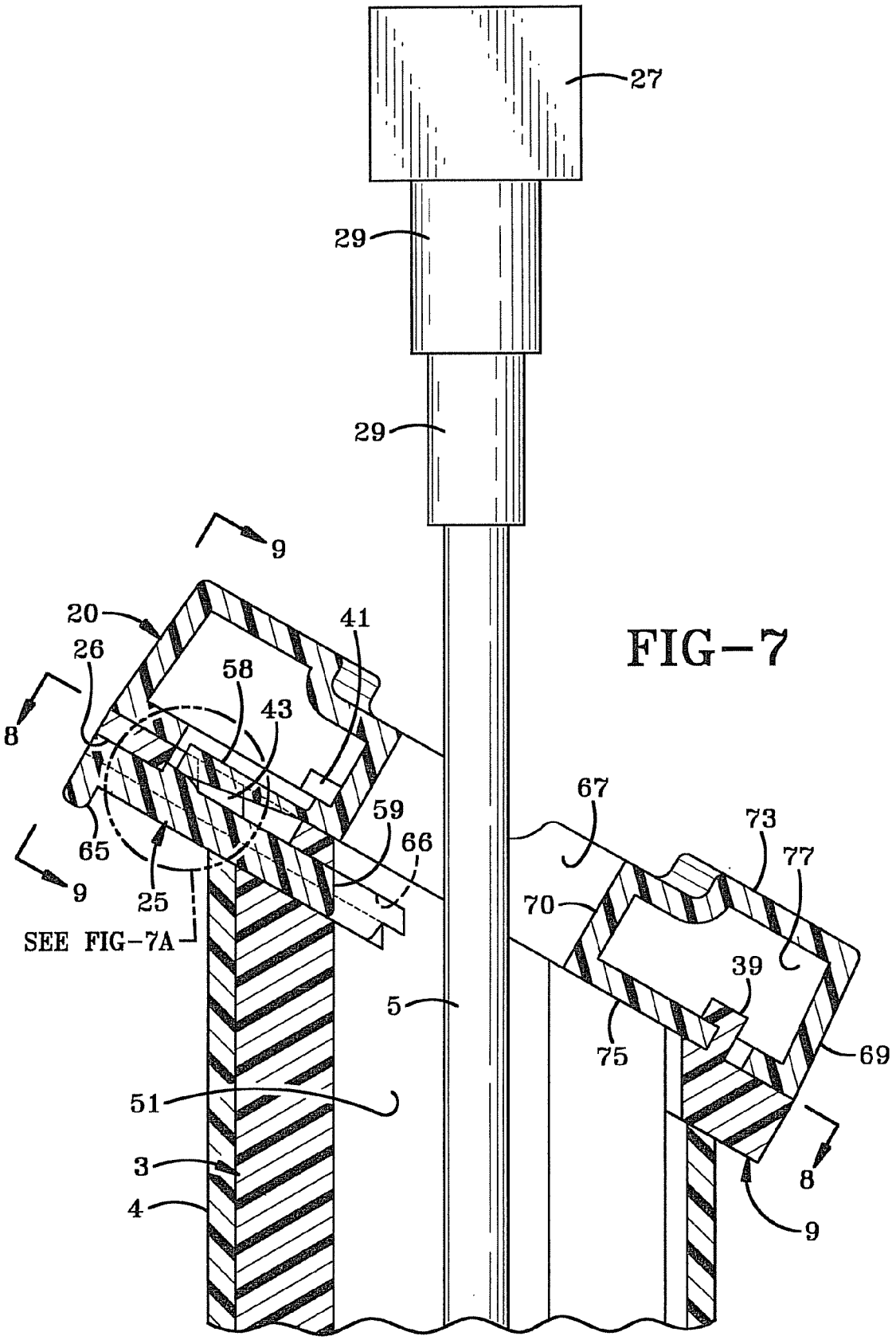
FIG. 7 illustrates a cross-sectional view of a display assembly with a cable stop.

In the preferred embodiment, the cable stop 25 may include a linear protrusion 65 (e.g., lip) at the end of the cable stop 25 that extends below a central body portion 63 of cable stop 25 (outside the base plate 9) as shown in FIGS. 5-7. The linear protrusion 65 may assist a user in the pulling or pushing of the cable stop 25 within base plate 9.

Additionally, the cable stop 25 may include one end that is a curved end 59 on the end of the cable stop 25 configured to block the tether 5 from being pulled into the base 3. The curved end 59 may be the same shape (diameter) as the inside of the base 3, when the cable stop 25 is not in a position to block the tether 5 as shown in FIG. 8.

In the preferred embodiment, the base plate 9 is configured with other features. For example, the base plate 9 may be configured with a center "L" tab 39 and a pair of side "L" tabs 41. These tabs can interlock with complementary components on the mounting adapter 20 when the mounting adapter 20 is mounted on the base plate 9. The mounting adapter 20 is therefore, changeable to allow different combinations of mounting adaptors 20 and mounting members 7 to be used with the display assembly 1. The base plate 9 may be formed with a flat surface 37 and may be configured to receive the mounting adapter 20 with the "L" tabs 39, 41 formed on the flat surface 37. The mounting adaptor 20 may include a wall 69, a cylindrical wall 70, a top wall 73, and a bottom wall 75 formed to create a cavity 77. Other combinations of walls can be configured to implement additional cavities to shape the mounting adaptor 20 so that the mounting adaptor 20 is adapted to receive the required mounting member 7.

Figure 7A:
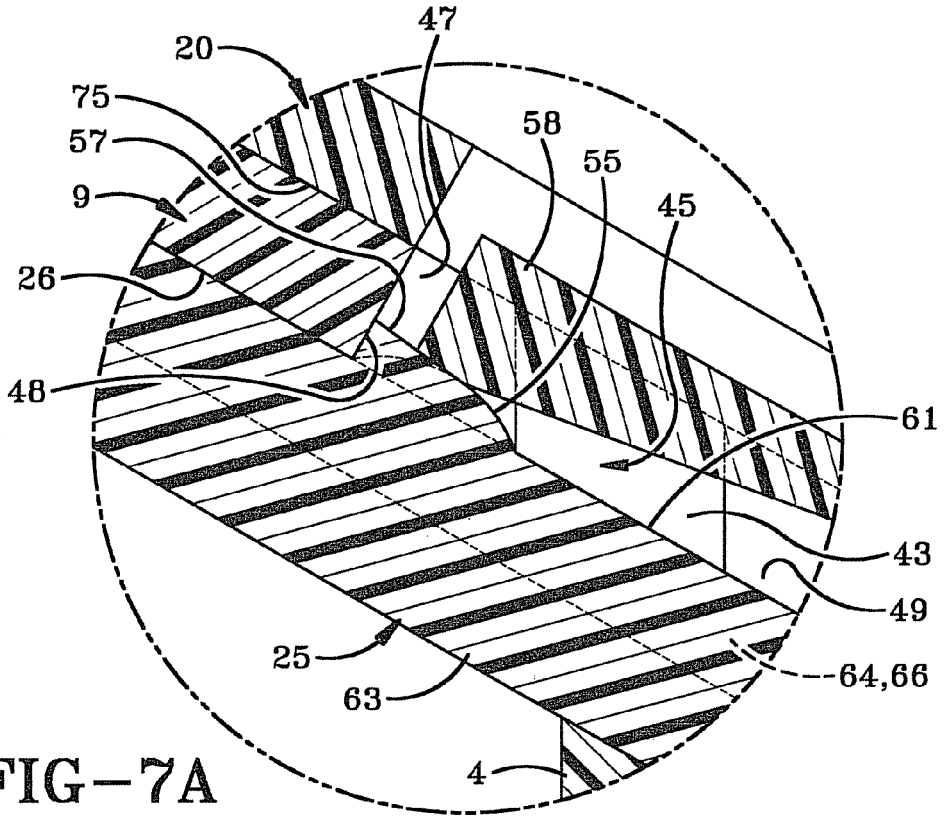
FIG. 7A illustrates an enlarged fragmentary view of a portion of FIG. 7.
Figure 10A:
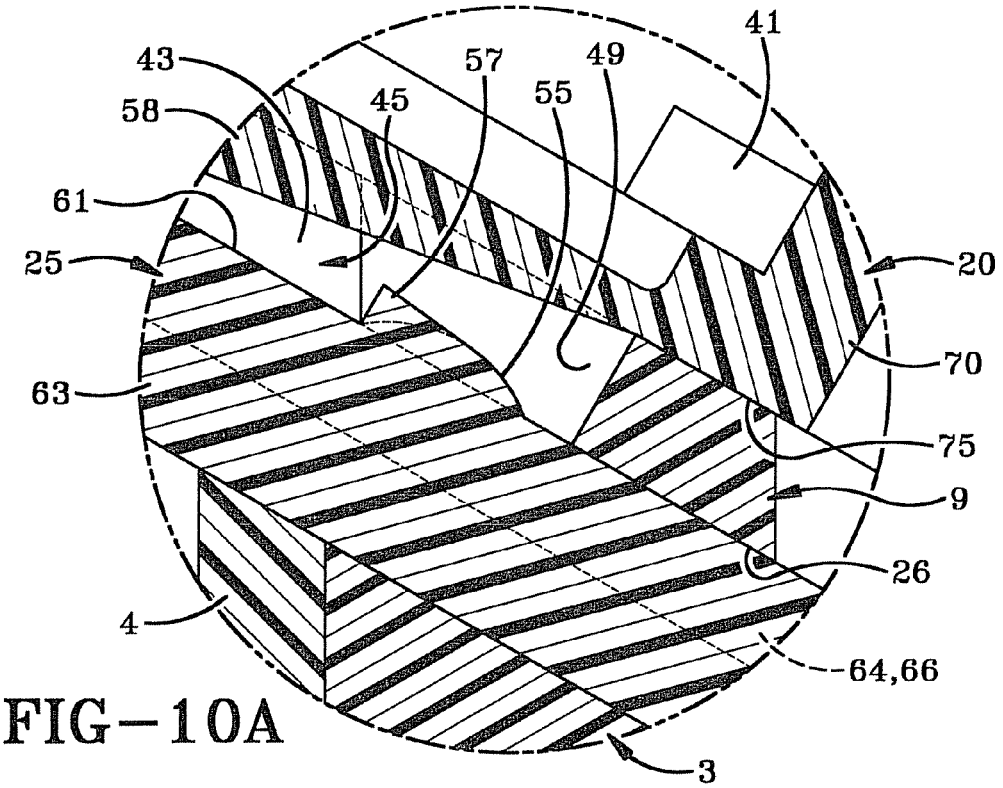
FIG. 10A illustrates an enlarged fragmentary view of a portion of FIG. 10.

In the preferred embodiment, the mounting adaptor 20 may include a bias member 58 as best shown in FIGS. 7 and 7A. The bias member 58 is in contact with the cable stop 25 in the open (e.g., retracted) position. This contact may create a bias on the cable stop 25 to ensure that the cable stop 25 remains in the open position until enough force is applied to overcome this bias.

The mounting member 7 may be connected to the tether 5 with a connector 27. The connector 27 may provide electrical connections between the mounting member 7 and the tether 5. The connector 27 may include one or more conical connector portions 29 (see FIG. 7). These portions 29 may be arranged from smallest to largest, with the largest adjacent the connector 27. This configuration may allow the cable stop 25 to stop the tether 5 at one of these portions 29 before reaching the connector 27.

Example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks.

Figure 12:
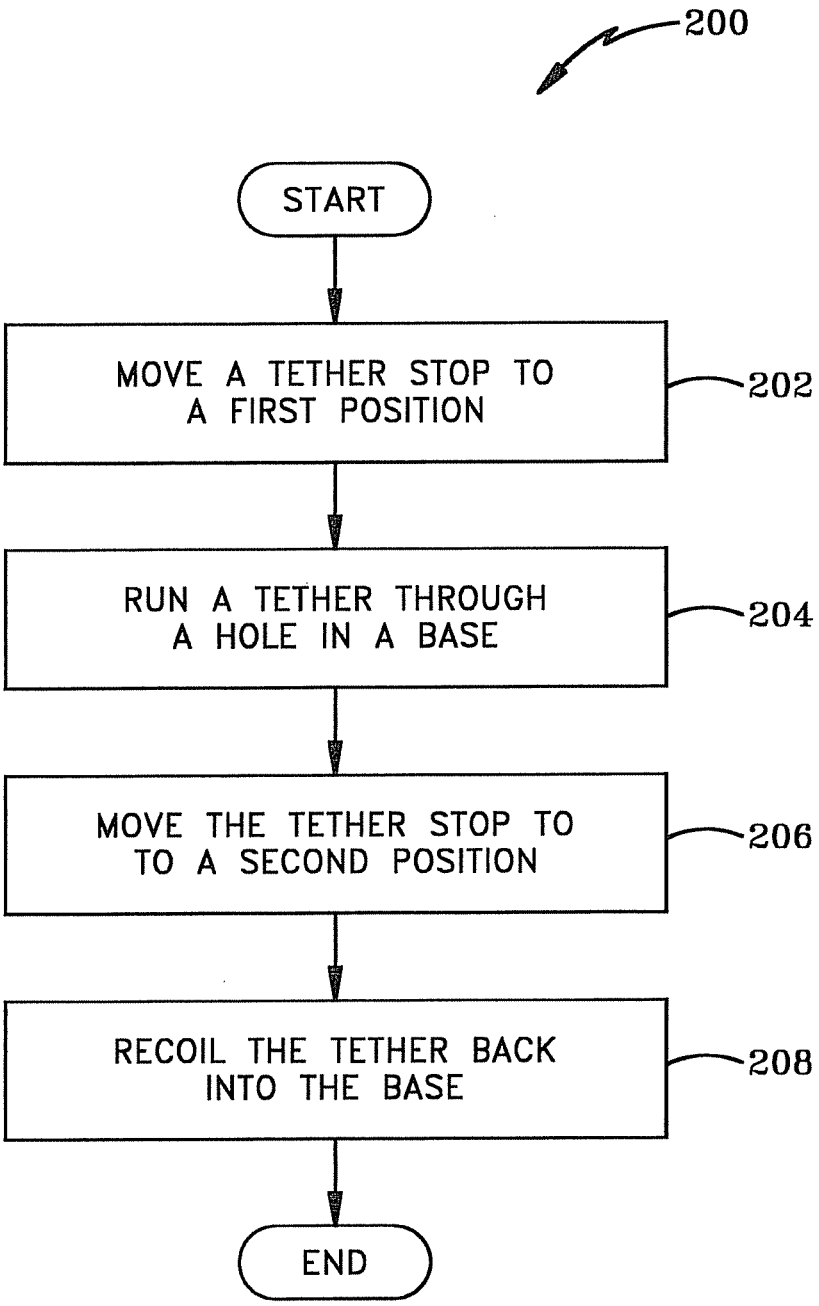
FIG. 12 illustrates a method associated with a display assembly with a cable stop.

FIG. 12 illustrates an embodiment of a method 200 associated with mounting a merchandise display apparatus. The method 200 allows the merchandise display apparatus to display a merchandise item in a way that allows a customer to pick up the merchandise item from the merchandise display apparatus. The customer may view, rotate, and explore the merchandise item to determine if the customer wants to purchase the item. The method 200 allows for a tether that is connected to a mounting member that the merchandise item is connected to be removed from the mounting member without the tether being recoiled into the base head.

The method 200 begins by moving a tether stop to a first position at 202. The tether stop may be part of a base. In the first position, the tether stop may be in an open position to allow the tether to pass through the base. The method 200 passes the tether through a hole in the base, at 204, when the tether stop is in the first position.

In the preferred embodiment, after the tether is passed through the hole, a connector on the tether may be connected to a mounting member. A connector attached to a tether is adapted to be attached to a mounting member. The connector is permitted to pass through the base when the tether stop is in the first position. The mounting member is movable between a mounted position in contact with the base. The mounting member can be removed from the base to facilitate viewing and handling of a consumer item securely attached to the mounting member.

The method 200 moves the cable stop to a second position at 206. The second position may correspond to a blocking position. The blocking position may be a partially closed position that at least partially closes the hole in the base, however, the tether can still be recoiled into the base. The tether is recoiled back into the base at 208. A connector attached to the tether is prevented from passing into the base when the tether stop is in the second position.

In another embodiment, the method moves the tether stop by sliding the tether stop between two adjacent grooves in a surface mount at one end of the base. The surface mount is adapted for receiving the merchandise mount.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in the preferred embodiment" does not necessarily refer to the same embodiment, though it may.

The invention claimed is:

1. A display assembly comprising:

a base comprising an opening and a cable stop that cannot be withdrawn from the base, the base being configured to be secured to a display surface;

a mounting member configured to be mounted on a display item, wherein the mounting member is movable between a mounted position in contact with the base, and wherein the mounting member is configured to be removed from the base to facilitate viewing and handling of the display item;

a connector;

a tether with the connector attached at one end of the tether, wherein the connector is configured to attach to the mounting member; and a recoiler configured to recoil the tether;

wherein the cable stop is configured to slide within the base between a non-blocking position to allow the connector to pass through the opening and a blocking position to at least partially block the opening in the base to prevent the connector from passing through the opening.

2. The display assembly of claim 1, further comprising:

two slots in the base on opposite sides of the opening; and wherein the cable stop is located between the two slots.

3. The display assembly of claim 1, further comprising:

grooves between the non-blocking position and the blocking position; and wherein the cable stop is configured to slide in the grooves.

4. The display assembly of claim 1, further comprising:

a bump on the cable stop; and wherein the cable stop is a substantially flat surface that includes the bump.

5. The display assembly of claim 4, further comprising:

a first portion of a second opening in the base;

a second portion of the second opening; and wherein the bump is configured to move under a pair of tabs separating the first portion of the second opening and the second portion of the second opening.

6. The display assembly of claim 4, further comprising:

a first depression in the base;

a second depression in the base; and wherein the cable stop is configured to move to the non-blocking position when the bump is pushed to the first depression, and wherein the cable stop is configured to move to the blocking position when the bump is pushed to the second depression.

7. The display assembly of claim 1, wherein the cable stop further comprises:

a first side in a first channel in the base;

a second side in a second channel in the base; and wherein the cable stop is configured to move between the non-blocking position and the blocking position by sliding in the first channel and the second channel.

8. The display assembly of claim 1, wherein when the cable stop is in the blocking position the connector is prevented from passing through the opening and the tether is not prevented from passing through the opening.

9. The display assembly of claim 1, wherein the cable stop is substantially flat.

10. The display assembly of claim 1, wherein the recoiler is configured to automatically recoil the tether, and wherein the cable stop prevents the connector from passing through the opening when the cable stop is in the non-blocking position.

11. The display assembly of claim 1, further comprising;

an external alarm external to the display assembly; and wherein the tether is configured to provide a signal to the external alarm when the tether is cut.

12. A consumer display assembly comprising:

a display post comprising an opening and a blocker device that cannot be withdrawn from the display post, the display post being configured to be secured to a display surface;

an anti-theft tether running through the opening in the display post;

a merchandise mount configured to be securely mounted on a consumer merchandise item; and a connector attached to one end of the anti-theft tether, the connector being configured to attach to the merchandise mount, wherein the anti-theft tether is configured to transmit a signal to a security system when the anti-theft tether is cut wherein the a blocker device is configured to slide between a non-blocking position and a blocking position, wherein when the blocker device is in the blocking position the blocking device at least partially blocks the opening in the display post to prevent the connector from passing through the opening in the display post.

13. The consumer display assembly of claim 12, further comprising:

two or more grooves in the display post; and wherein the blocker device is configured to slide between the two or more grooves.

14. The consumer display assembly of claim 12, further comprising:

a surface mount at one end of the display post adapted for receiving the merchandise mount; and wherein the blocker device is configured to move in the surface mount.

15. The consumer display assembly of claim 14, further comprising:

an opening in the surface mount;

a first portion of the opening in the surface mount;

a second portion of the opening in the surface mount;

a substantially flat surface on the blocker device;

at least one projection on the flat surface; and wherein the blocker device is configured to be in the non-blocking position when the at least one projection is in the first portion of the opening in the surface mount, and wherein the blocker device is adapted to be in the blocking position when the at least one projection is in the second portion of the opening of the surface mount.

16. The consumer display assembly of claim 12, wherein the merchandise mount is movable between a mounted position in contact with the display post, and wherein the merchandise mount is configured to be removed from the display post to facilitate viewing and handling of the consumer merchandise item.

17. A method comprising:

moving a tether stop to a non-blocking position, wherein the tether stop is in a base and cannot be withdrawn from the base, the base being configured to be secured to a display surface, wherein a connector attached to a tether is configured to attach to a mounting member, wherein the connector is permitted to pass through an opening in the base when the tether stop is in the non-blocking position, wherein the mounting member is movable between a mounted position in contact with the base, and wherein the mounting member is configured to be removed from the base to facilitate viewing and handling of a consumer item securely attached to the mounting member;

running a tether through the opening in the base when the tether stop is in the non-blocking position;

sliding the tether stop within the base to a blocking position where the tether stop at least partially blocks the opening in the base; and recoiling the tether into the base, wherein the connector is prevented from passing through the opening in the base when the tether stop is in the blocking position.

18. The method of claim 17, wherein sliding the tether stop includes sliding the tether stop between two adjacent grooves in a surface mount at one end of the base, and wherein the surface mount is configured to receiving the merchandise mount.

* * * * *